US010002504B2

(12) United States Patent
Janardhanan et al.

(10) Patent No.: US 10,002,504 B2
(45) Date of Patent: Jun. 19, 2018

(54) SYSTEM AND METHOD OF PROVIDING INTELLIGENT SYSTEM TROUBLE NOTIFICATIONS USING LOCALIZATION

(71) Applicant: Honeywell International Inc., Morristown, NJ (US)

(72) Inventors: Shaiju Janardhanan, Bangalore (IN); Hemanth P V, Bangalore (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 192 days.

(21) Appl. No.: 14/872,715

(22) Filed: Oct. 1, 2015

(65) Prior Publication Data

US 2017/0098352 A1 Apr. 6, 2017

(51) Int. Cl.
*G08B 29/06* (2006.01)
*G08B 13/12* (2006.01)
*G08B 29/08* (2006.01)

(52) U.S. Cl.
CPC ..... *G08B 13/12* (2013.01); *G08B 29/08* (2013.01)

(58) Field of Classification Search
CPC ..... G08B 21/0219; G08B 21/02; G08B 21/0227; A61B 5/0002; A61B 5/002
USPC ..... 700/292–294
See application file for complete search history.

(56) References Cited

U.S. PATENT DOCUMENTS 4,151,459 A 4/1979 Fayolle et al.
5,568,399 A * 10/1996 Sumic ..... G01R 31/086 700/293
6,687,574 B2 * 2/2004 Pietrowicz ..... H02J 13/0024 700/292
6,954,814 B1 * 10/2005 Leach ..... G01D 4/004 340/870.02
7,443,289 B2 10/2008 Smith
7,551,984 B1 * 6/2009 Fickey ..... G06Q 10/06 700/286
7,627,453 B2 * 12/2009 Keefe ..... G05B 23/0267 345/589
8,249,731 B2 * 8/2012 Tran ..... A61B 5/1113 222/23

(Continued)

FOREIGN PATENT DOCUMENTS

EP 0 549 937 A1 7/1993
GB 2 418 050 A 3/2006

OTHER PUBLICATIONS

Extended European search report for corresponding EP patent application 16191249.8, dated Dec. 7, 2016.

*Primary Examiner* — Hai Phan
*Assistant Examiner* — Son M Tang
(74) *Attorney, Agent, or Firm* — Husch Blackwell LLP

(57) ABSTRACT

Systems and methods of providing intelligent system trouble notifications using localization are provided. Some methods can include a dealer device receiving a first signal from a first control panel device indicative of a system trouble event at the first control panel device, the dealer device transmitting a second signal to each of a plurality of other control panel devices soliciting a status update therefrom, the dealer device receiving a respective third signal from each of the plurality of other control panel devices indicative of a respective system status, and the dealer device determining whether the system trouble event is local to the first control panel device or is area wide.

18 Claims, 2 Drawing Sheets

(56) References Cited

U.S. PATENT DOCUMENTS 8,779,919 B1 * 7/2014 Darling ..... H04W 4/22 340/539.16
9,041,544 B2 * 5/2015 Bagasra ..... G08B 27/005 340/657
9,183,578 B1 * 11/2015 Reeser ..... G06Q 30/04
9,626,858 B2 * 4/2017 Sloo ..... G08B 29/26
2003/0048304 A1 3/2003 Lontka et al.
2005/0068165 A1 * 3/2005 Kelliher ..... G07C 9/00166 340/523
2005/0242944 A1 * 11/2005 Bankert ..... G08B 25/00 340/531
2006/0055549 A1 * 3/2006 Fischer ..... G06F 1/30 340/635
2006/0217936 A1 * 9/2006 Mason ..... G01D 4/004 702/188
2008/0183339 A1 * 7/2008 Vaswani ..... G01D 4/004 700/297
2009/0034411 A1 * 2/2009 Bernard ..... H04L 41/06 370/221
2009/0135018 A1 * 5/2009 Veillette ..... H04L 41/06 340/657
2012/0200426 A1 * 8/2012 DiLuciano ..... H04L 41/0645 340/870.07
2013/0257623 A1 * 10/2013 Bagasra ..... G08B 27/005 340/657
2014/0003816 A1 * 1/2014 Yeh ..... H04B 10/27 398/66
2014/0133291 A1 * 5/2014 Jammer ..... H04W 52/0219 370/222
2014/0145855 A1 5/2014 Boisclair
2014/0201072 A1 * 7/2014 Reeser ..... G06Q 30/04 705/40
2014/0201315 A1 * 7/2014 Jacob ..... H04L 12/2803 709/217
2015/0097663 A1 * 4/2015 Sloo ..... G01N 27/02 340/501
2015/0099531 A1 * 4/2015 Steiger ..... H04W 4/02 455/456.1
2015/0100166 A1 * 4/2015 Baynes ..... F24F 11/0009 700/278
2015/0264547 A1 * 9/2015 Kobayashi ..... G06Q 50/26 455/404.2
2016/0141869 A1 * 5/2016 Byron ..... H02J 3/00 700/291
2016/0173963 A1 * 6/2016 Filson ..... H04L 12/1895 340/870.09
2017/0083072 A1 * 3/2017 Dauneria ..... H04W 4/005

* cited by examiner

SYSTEM AND METHOD OF PROVIDING INTELLIGENT SYSTEM TROUBLE NOTIFICATIONS USING LOCALIZATION

FIELD

The present invention relates generally to security systems and methods. More particularly, the present invention relates to a system and method of providing intelligent system trouble notifications using localization.

BACKGROUND

Known security systems include a control panel device that monitors a region in which it is installed and transmits alert signals and notifications to a central monitoring station regarding any trouble or alarm event. When user notifications are enabled, the control panel device can also transmit the alert signals and notifications to a user device, for example, a mobile telephone.

When system trouble occurs, such as a power or communication failure, the user device and the central monitoring station can receive a signal from the control panel device with a system trouble alert. System trouble can be limited to a user's monitored premises or be spread across an entire region or area, for example, an area wide power outage. However, regardless of the type of system trouble, the user device and the central monitoring station receive the same type of system trouble alert and, therefore, have no way to distinguish between system trouble limited to the user's premises and an area wide system trouble.

Indeed, when the system trouble alert is limited to the user's monitored premises, there is a need for the user to be extra alert and proactive because the trouble may be due to a burglar or other unauthorized intruder cutting a power supply to the premises. However, known systems and methods provide no way for the user to identify such an event.

Moreover, when the system trouble alert is area wide, many control panel devices throughout the area might transmit the system trouble alert or a notification signal to the central monitoring station, thereby overloading a network. Such area wide power and communication failures are rampant in developing nations so overloading networks is of high concern.

In view of the above, there is a continuing, ongoing need for improved systems and methods.

DETAILED DESCRIPTION

Figure 1:
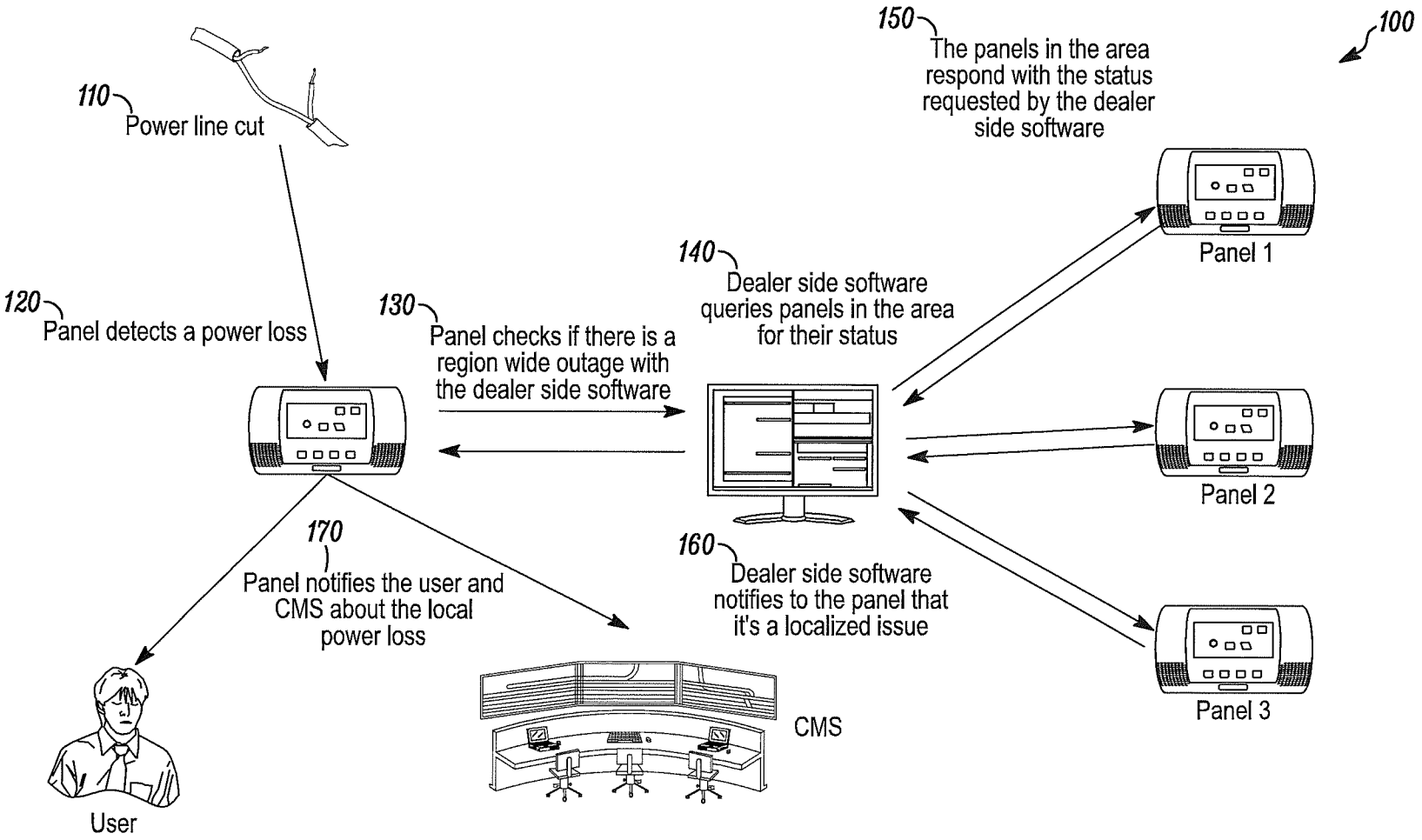
FIG. 1 is a flow diagram of a method in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein include systems and methods of providing intelligent system trouble notifications using localization. For example, systems and methods disclosed herein can distinguish between system trouble limited to a user's monitored premises and system trouble spread across an entire region or area.

Systems and methods disclosed herein are described in connection with system trouble that includes power and communication outages. However, it is to be understood that systems and methods disclosed herein are not so limited and can also be used in connection with control panel devices detecting other types of system trouble or facility breakdowns, such as water supply breakdowns.

In accordance with disclosed embodiments, when a system trouble event occurs at a first control panel device, such as a power or communication failure, systems and methods disclosed herein can confirm whether a plurality of other control panel devices within a predetermined area are experiencing the same system trouble event. For example, a dealer device can execute a software application in accordance with disclosed embodiments and can support or service the first control panel device and the plurality of other control panel devices. When the system trouble event occurs at the first control panel device, the first control panel device can transmit a request signal to the dealer device. Upon receiving the request signal, the dealer device can transmit a corresponding status request signal to the plurality of other control panel devices, including control panel devices that are supported or serviced by the dealer device and are within the predetermined area, for example, within the same area code or zip code as the first control panel device. Indeed, in some embodiments, the dealer device can include a database of the control panel devices supported by the dealer device and their corresponding area codes or zip codes. In some embodiments, the dealer device can transmit signals, alerts, or notifications to all of the control panel devices within the predetermined area of the dealer device, and in some embodiments, the dealer device can reply to all request signals received from the control panel devices, thereby increasing the reliability of systems and methods disclosed herein.

Responsive to the status request signal transmitted by the dealer device, each of the plurality of other control panel devices can transmit a respective status signal to the dealer device. Based on received status signals, the dealer device can determine whether the system trouble event is limited to the premises of the first control panel device or is area wide.

Indeed, if the dealer device receives a status signal from one or more of the control panel devices indicating system trouble, then the dealer device can determine that the system trouble is area wide and notify the first control panel device accordingly. Based upon such a notification, the first control panel device can transmit an alert signal to a user device indicative of area wide system trouble, can display a trouble signal locally, and depending on network traffic concerns, may or may not transmit the alert signal to a central monitoring station. When the first control panel device does not transmit the alert signal to the central monitoring station to notify the central monitoring station about the area wide system trouble, the number of notifications sent to the central monitoring station can be reduced.

Conversely, if the dealer device receives a status signal from all of the control panel devices in the plurality of control panel devices indicating no system trouble, then the dealer device can determine that the system trouble is limited to the premises of the first control panel device and notify the first control panel device accordingly. Based on such a notification, the first control panel device can transmit the alert signal to both the user device and the central monitoring station advising of localized system trouble. Accordingly, the user can be alerted to be extra cautious and take necessary and precautionary steps and measures to remove the localized system trouble.

In some embodiments, the control panel devices and the dealer device described herein can communicate via a communication path that is different than a communication path via which the control panel devices communicate with other devices. For example, the control panel devices can communicate with the user device or the central monitoring station via a telephone line and can communicate with the dealer device via a GSM based communication network. Accordingly, even when a fixed telephone line to the user's home is cut, one of the control panel devices at the user's home can confirm with the dealer device that the system trouble is localized, instead of assuming that it is the area wide system trouble. Once the user confirms the localized system trouble, he can inspect his home premises to identify possible reasons for the system trouble.

In some embodiments, the control panel devices can communicate with the dealer device via a secured communication channel. In these embodiments, requests and signals from the control panel devices will only be recognized by the dealer device with which the control panel devices are registered. Similarly, in these embodiments, the dealer device can transmit requests and signals to only the control panel devices registered with the dealer device and identified by the dealer device as being in the same area as a requesting one of the control panel devices.

FIG. 1 is a flow diagram of a method 100 in accordance with disclosed embodiments. As seen in FIG. 1, the method 100 can include a power line to a first control panel device being cut by a burglar or other unauthorized intruder as in 110 and the first control panel device detecting power loss as in 120. Upon detecting the power loss as in 120, the first control panel device can transmit a signal to a dealer device as in 130 to determine whether the power loss is local to the first control panel device or is area wide.

Upon receipt of the signal from the first control panel device as in 130, the dealer device can transmit a signal to a plurality of control panel devices (Panels 1, 2, 3) within a predetermined area of the first control panel device as in 140 requesting a status of each of the plurality of control panel devices. For example, the dealer device can identify an area code of the first control panel device from an internal database device and identify the plurality of control panel devices as all other control panel devices in the identified area code. In some embodiments, the dealer device can transmit the signal as in 140 to only a fixed number of the other control panel devices in the identified area code.

Upon receiving the signal from the dealer device as in 140, each of the plurality of control panel devices can transmit a respective signal to the dealer device as in 150 advising the dealer device of its respective status. Responsive thereto, the dealer device can analyze the respective signal from each of the plurality of control panel devices to determine whether the power loss at the first control panel device is local to the first control panel device or is area wide. For example, if another control panel device in the plurality of control panel devices reported the power loss to the dealer device, then the dealer device can determine that the power loss is area wide. However, if no other control panel device in the plurality of control panel devices reported the power loss to the dealer device, then the dealer device can determine that the power loss is local to the first control panel device.

As seen in FIG. 1, when the dealer device determines that the power loss is local to the first control panel device, the dealer device can transmit a signal to the first control panel device as 160 notifying the first control panel device that the power loss is a localized issue. Upon receipt of the signal from the dealer device as in 160, the first control panel device can transmit a signal to a user device and to a central monitoring station as in 170 notifying the user device and the central monitoring station about the power loss being local.

Figure 2:
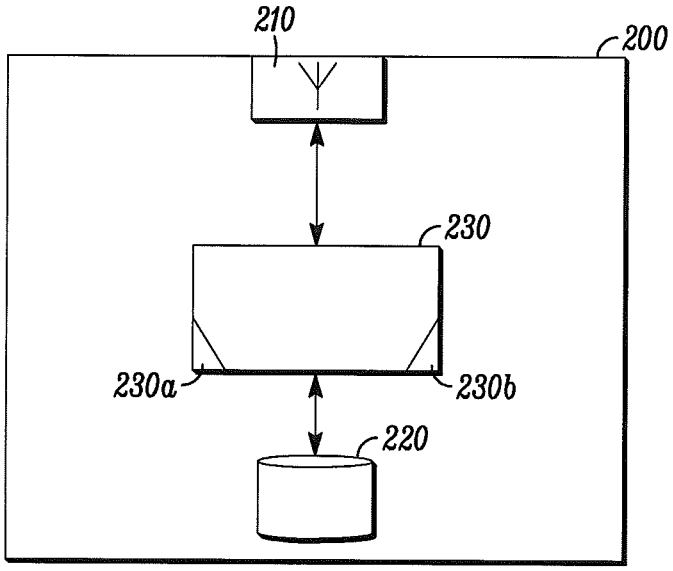
FIG. 2 is a block diagram of a dealer device in accordance with disclosed embodiments.

FIG. 2 is a block diagram of a dealer device 200 in accordance with disclosed embodiments. As seen in FIG. 2, the dealer device 200 can include a wireless transceiver 210, a memory device 220, control circuitry 230, one or more programmable processors 230*a*, and executable control software 230*b* as would be understood by one of ordinary skill in the art. The executable control software 230*b* can be stored on a transitory or non-transitory computer readable medium, including, but not limited to local computer memory, RAM, optical storage media, magnetic storage media, flash memory, and the like. In some embodiments, the control circuitry 230, programmable processors 230*a*, and control software 230*b* can execute and control the methods as described above and herein.

The wireless transceiver 210 can communicate with control panel devices as described above, and the memory device 220 can store a database of the control panel devices and their associated area codes, zip codes, or the like. The control circuitry 230, programmable processors 230*a*, and control software 230*b* can instruct the transceiver 210 to transmit signals as described above and can process received request signals and status signals to determine whether identified system trouble is local to a particular one of the control panel devices or area wide.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

a dealer device receiving a first signal from a first control panel device indicative of a system trouble event at the first control panel device;

the dealer device transmitting a second signal to each of a plurality of other control panel devices soliciting a status update therefrom;

the dealer device receiving a respective third signal from each of the plurality of other control panel devices indicative of a respective system status;

the dealer device determining whether the system trouble event is local to the first control panel device or is area wide;

responsive to the determining, the dealer device transmitting a fourth signal to the first control panel device indicative of the system trouble event being local to the first control panel device or area wide;

when the fourth signal is indicative of the system trouble event being area wide, the first control panel device refraining from notifying a central monitoring station of the system trouble event; and when the fourth signal is indicative of the system trouble event being local to the first control panel device, the first control panel device notifying the central monitoring station of the system trouble event.

2. The method of claim 1 further comprising the dealer device identifying each of the plurality of other control panel devices based on a respective location of each of the plurality of other control panel devices being within a predetermined area associated with the first control panel device.

3. The method of claim 1 further comprising:

the dealer device identifying, from an internal database device, a first area code of the first control panel device; and the dealer device identifying each of the plurality of other control panel devices by identifying, from the internal database device, a respective second area code of each of the plurality of other control panel devices equal to the first area code of the first control panel device.

4. The method of claim 1 further comprising identifying each of the plurality of other control panel devices by identifying each of the plurality of other control panel devices as being supported by the dealer device.

5. The method of claim 1 further comprising the dealer device determining that the system trouble event is local to the first control panel device when the respective third signal received from none of the plurality of other control panel devices is indicative of trouble.

6. The method of claim 1 further comprising the dealer device determining that the system trouble event is area wide when the respective third signal received from at least one of the plurality of other control panel devices is indicative of trouble.

7. The method of claim 1 further comprising the dealer device determining that the system trouble event is area wide when the respective third signal received from at least a predetermined number of the plurality of other control panel devices is indicative of trouble.

8. The method of claim 1 wherein, when the fourth signal is indicative of the system trouble event being area wide, the fourth signal includes instructions for the first control panel device to refrain from notifying the central monitoring station of the system trouble event, and wherein, when the fourth signal is indicative of the system trouble being local to the first control panel device, the fourth signal includes instructions for the first control panel device to notify the central monitoring station of the system trouble event and to transmit a fifth signal to a user device to notify a user about the system trouble event.

9. The method of claim 1 wherein the dealer device communicates with the first control panel device via a first communication network that is different than communication networks via which the first control panel device communicates with different devices.

10. A system comprising:

a transceiver;

a programmable processor; and executable control software stored on a non-transitory computer readable medium, wherein the transceiver receives a first signal from a first control panel device indicative of a system trouble event at the first control panel device, wherein the transceiver transmits a second signal to each of a plurality of other control panel devices soliciting a status update therefrom, wherein the transceiver receives a respective third signal from each of the plurality of other control panel devices indicative of a respective system status, wherein the programmable processor and the executable control software determine whether the system trouble event is local to the first control panel device or is area wide, and responsive thereto, the transceiver transmits a fourth signal to the first control panel device indicative of the system trouble event being local to the first control panel or area wide, wherein, when the fourth signal is indicative of the system trouble event being area wide, the fourth signal includes instructions directing the first control panel device to refrain from notifying a central monitoring station of the system trouble event, and wherein, when the fourth signal is indicative of the system trouble event being local to the first control panel device, the fourth signal includes instructions directing the first control panel device to notify the central monitoring station of the system trouble event.

11. The system of claim 10 wherein the programmable processor and the executable control software identify each of the plurality of other control panel devices based on a respective location of each of the plurality of other control panel devices being within a predetermined area associated with the first control panel device.

12. The system of claim 10 further comprising a database device, wherein the programmable processor and the executable control software identify, from the database device, a first area code of the first control panel device, and wherein the programmable processor and the executable control software identify each of the plurality of other control panel devices by identifying, from the database device, a respective second area code of each of the plurality of other control panel devices equal to the first area code of the first control panel device.

13. The system of claim 10 wherein the programmable processor and the executable control software identify each of the plurality of other control panel devices by identifying each of the plurality of other control panel devices as being serviced thereby.

14. The system of claim 10 wherein the programmable processor and the executable control software determine that the system trouble event is local to the first control panel device when the respective third signal received from none of the plurality of other control panel devices is indicative of trouble.

15. The system of claim 10 wherein the programmable processor and the executable control software determine that the system trouble event is area wide when the respective third signal received from at least one of the plurality of other control panel devices is indicative of trouble.

16. The system of claim 10 wherein the programmable processor and the executable control software determine that the system trouble event is area wide when the respective third signal received from at least a predetermined number of the plurality of other control panel devices is indicative of trouble.

17. The system of claim 10 wherein, when the fourth signal is indicative of the system trouble event being local to the first control panel device, the fourth signal includes instructions directing the first control panel device to transmit a fifth signal to a user device to notify a user about the system trouble event.

18. A system comprising:

a first control panel device;

a dealer device; and a plurality of other control panel devices, wherein the first control panel devices transmits a first signal to the dealer device indicative of a system trouble event at the first control panel device, wherein the dealer device identifies each of the plurality of other control panel devices as being within a predetermined area of the first control panel device and transmits a second signal to each of the plurality of other control panel devices soliciting a status update therefrom, wherein each of the plurality of other control panel devices transmits a respective third signal to the dealer device indicative of a respective system status, wherein, based on the respective third signal from each of the plurality of other control panel devices, the dealer device determines whether the system trouble event is local to the first control panel device or is area wide and, responsive thereto, transmits a fourth signal to the first control panel device indicative of the system trouble event being local to the first control panel device or area wide, wherein, when the fourth signal is indicative of the system trouble event being area wide, the first control panel device refrains from notifying a central monitoring station of the system trouble event, and wherein, when the fourth signal is indicative of the system trouble event being local to the control panel device, the first control panel device notifies the central monitoring station of the system trouble event.

* * * * *